United States Patent [19]

Appleton

[11] Patent Number: 4,943,243

[45] Date of Patent: Jul. 24, 1990

[54] WIRE CONNECTOR

[76] Inventor: Arthur I. Appleton, 22 Indian Creek Island, Miami Beach, Fla. 33154

[21] Appl. No.: 260,688

[22] Filed: Oct. 21, 1988

[51] Int. Cl.[5] ..... H01R 13/52

[52] U.S. Cl. ..... 439/289; 439/592

[58] Field of Search ..... 439/289, 278, 281, 592, 439/607, 608, 595, 598, 591, 819, 824

[56] References Cited

U.S. PATENT DOCUMENTS

| | | | |
|---|---|---|---|
| 2,749,526 | 6/1956 | Petersen | 439/592 X |
| 3,478,298 | 11/1969 | Nelson | 439/592 X |
| 3,486,161 | 12/1969 | Kraus et al. | 439/289 |
| 3,657,681 | 4/1972 | Falkner | 439/592 X |
| 3,693,133 | 9/1972 | Harbonn | 439/278 |
| 3,742,427 | 6/1973 | Ballard | 439/592 |
| 4,014,600 | 3/1977 | Gisewsky | 439/289 |
| 4,146,286 | 3/1979 | Jones | 439/289 |
| 4,166,663 | 9/1979 | Walker et al. | 439/289 |

*Primary Examiner*—William Briggs

*Attorney, Agent, or Firm*—Jones, Day, Reavis & Pogue

[57] ABSTRACT

A front housing including a terminal support made of resilient material and having a plurality of male terminals releasably imbedded therein. The male terminals are connected to corresponding electrical cable. A back housing including a second terminal support made of resilient material and having a plurality of female terminals imbedded therein. The female terminals are also connected to corresponding electrical cable. A clamping ring mounted on the front housing engages screwthreads formed on the back housing such that the front and back housings can be tightly secured together. As the clamping ring is tightened the male and female terminals contact one another and compress the resilient supports. Due to the natural resiliency of the support material a force maintaining a pressure connection between the male and female terminals is created.

7 Claims, 3 Drawing Sheets

FIG. 1
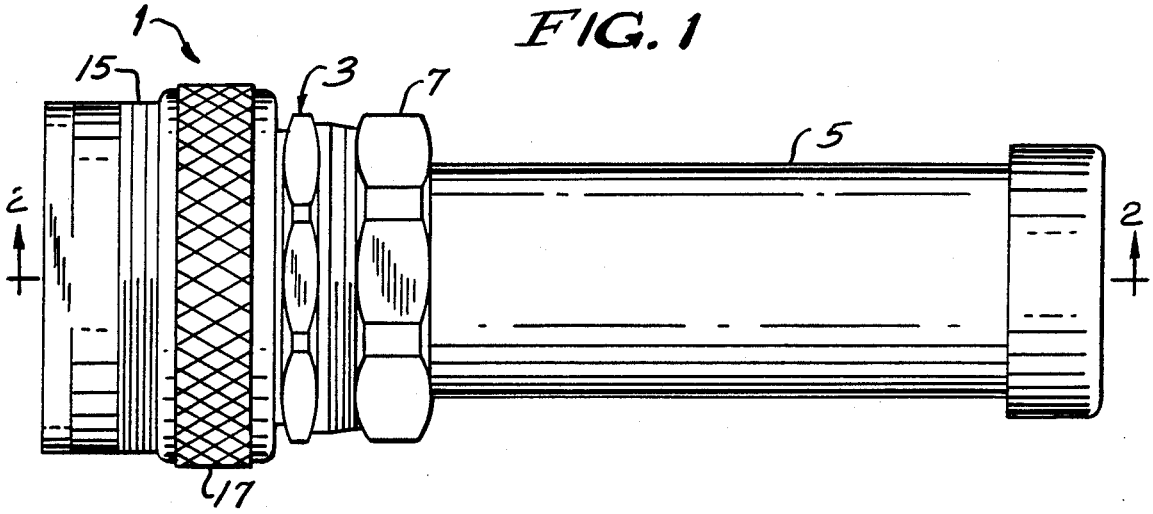
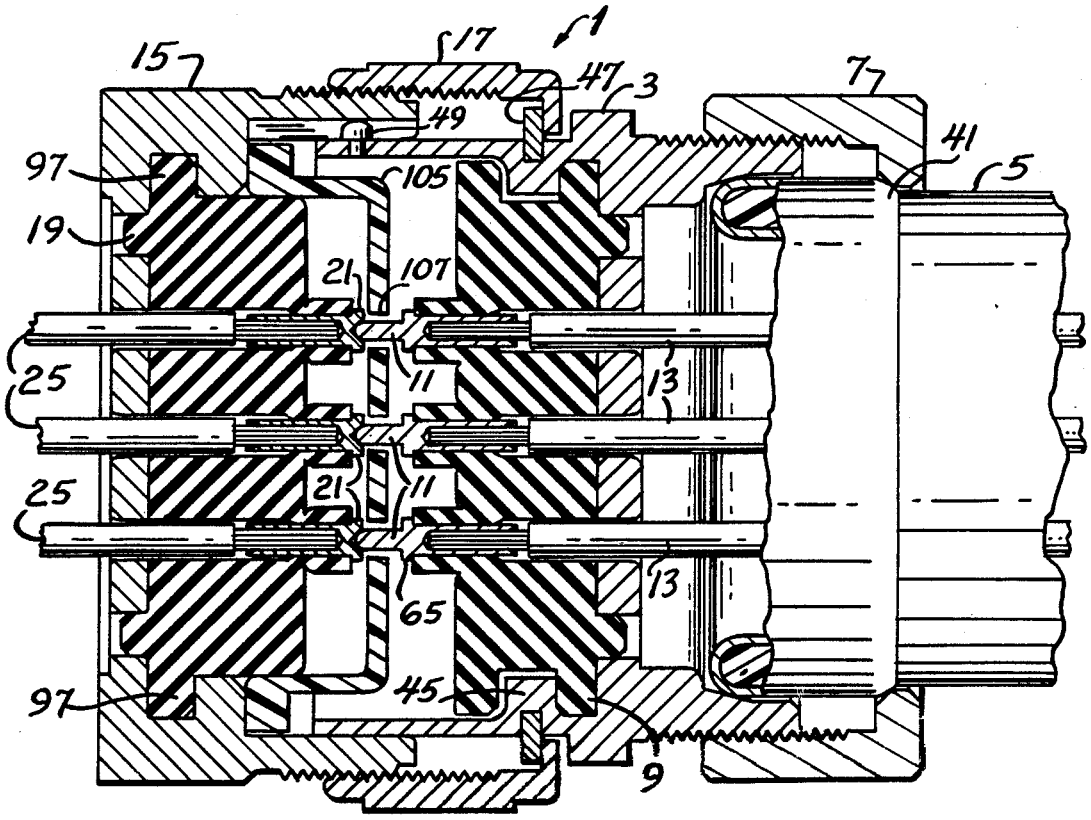
FIG. 2

FIG. 6
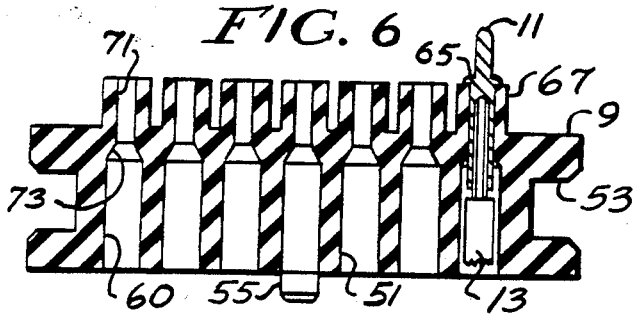
FIG. 5
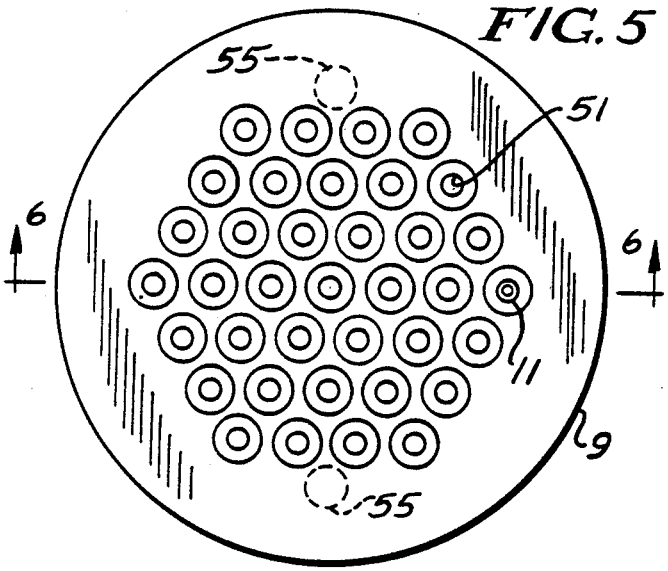
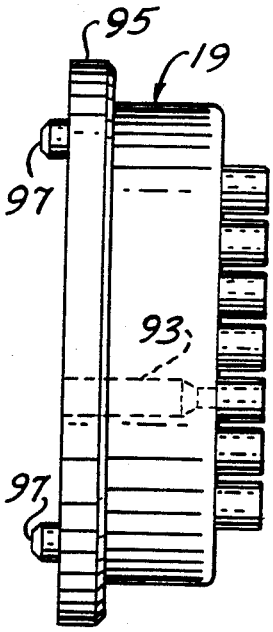
FIG. 9
FIG. 8
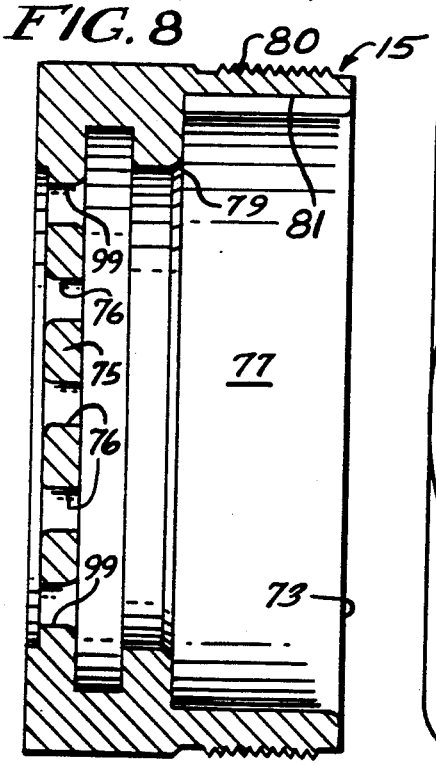
FIG. 7
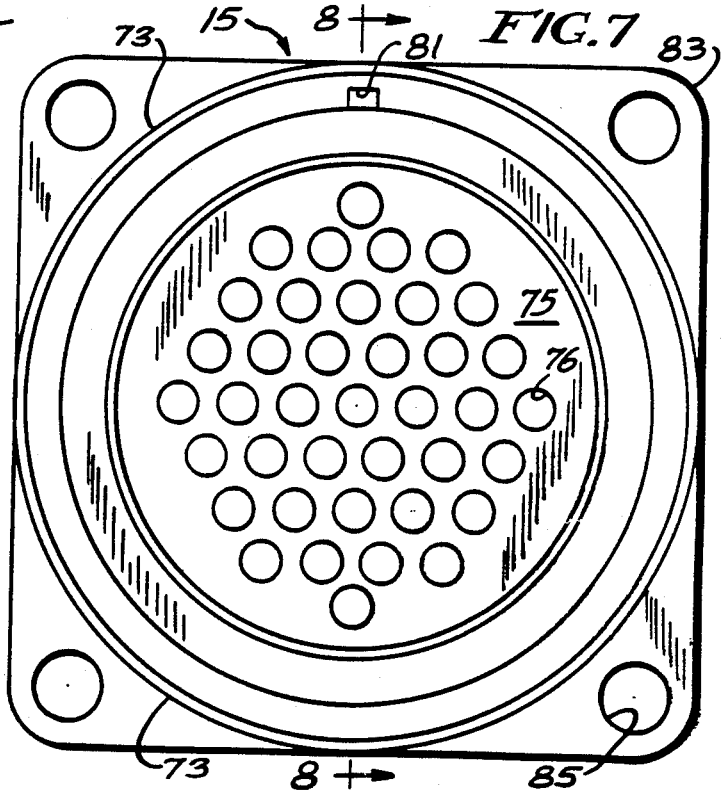

WIRE CONNECTOR

BACKGROUND OF THE INVENTION

This invention relates, generally, to wire connectors and, more particularly, to a connector for quickly and easily making the connection between multiple bare conductive terminals.

Such wire connectors typically consist of a plurality of terminals mounted in a first coupling element and connected one each to a first plurality of electrical cables. A corresponding number of terminals are also mounted in a second coupling element and are connected one each to a second plurality of electrical cables. The first and second coupling elements are secured to one another such that the terminals of the respective coupling elements contact one another and an electrical connection is made between the electrical cables.

Multiple connectors of this type have many applications including electrical power and/or control signal supply and are used in a variety of industries such as robotics, machine tools, computers and aerospace. However, inadequate contact between the terminals can result in interruption of the electrical signal. Therefore, it is important that these connectors provide adequate contact between the terminals of the first and second coupling elements. Moreover, in the interest of safety it is important that the terminal connection be isolated from the external environment.

BRIEF SUMMARY OF THE INVENTION

The present invention provides an improved wire connector consisting of a front housing secured to a flexible liquid-tight metallic conduit by a compression nut. The front housing includes a terminal support made of a resilient material. The terminal support has a plurality of male terminals removeably imbedded therein and connected to a corresponding number of electrical cables enclosed in the metallic conduit. A back housing is adapted to be mounted on a fixture of an industrial machine and includes a second terminal support also made of resilient material into which a plurality of female terminals are removably imbedded. The female terminals are also connected to a corresponding number of electrical cables. The front housing and back housing can be secured together by a clamping ring such that the male terminals engage the female terminals to create an electrical connection therebetween. As the front and back housings are tightly secured to one another by the clamping ring, the resilient material of the terminal supports is compressed such that the natural resiliency of the material provides a contact pressure between the terminals. Moreover, the engagement of the front and back housings and the action of the clamping ring effectively isolates the terminals from the external environment.

OBJECTS OF THE INVENTION

It is a general object of the invention to provide an improved multiple terminal connector.

It is another object of the invention to provide a connector in which an adequate pressure contact between the terminals is produced.

It is a further object of the invention to provide a connector in which the number of terminals can be quickly and easily varied.

It is yet another object of the invention to provide a connector in which the terminals are effectively isolated from the external environment.

Other objects of the invention, in addition to those set forth above, will become apparent to one of ordinary skill in the art from the following detailed description of the invention.

BRIEF DESCRIPTION OF THE DRAWINGS

FIG. 1 shows a side view of the connector in its assembled condition;

FIG. 2 shows a section view taken along line 2—2 of FIG. 1;

FIG. 5 shows a front view of the first terminal support of the invention;

FIG. 6 shows a section view of the first terminal support taken along the line 6—6 of FIG. 5 of the invention;

FIG. 7 shows a front view of the back housing of the invention; and

FIG. 8 shows a section view of the back housing taken along lines 8—8 of FIG. 7;

FIG. 9 shows a side view of the second terminal support of the invention.

DETAILED DESCRIPTION OF THE INVENTION

Figure 4:
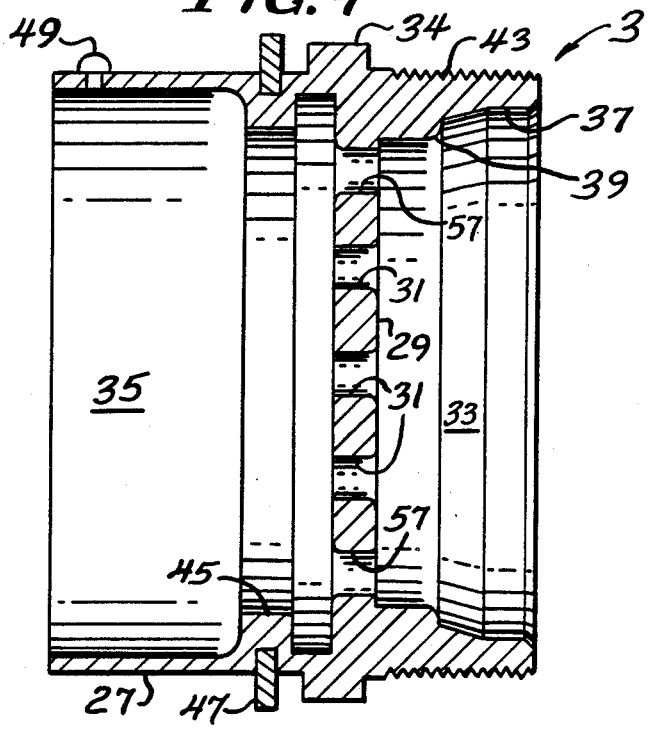
FIG. 4 shows a section view of the front housing of of the invention taken along line 4—4 of FIG. 3.

The connector of the invention is shown, generally, at 1 in FIGS. 1 and 2 and consists of a front housing 3 connected to a flexible liquid-tight metallic conduit 5 by a compression nut 7. The compression nut 7 engages ferule 41 to retain conduit 5 in front housing 3. The front housing 3 supports a terminal support 9 having a plurality of male terminals 11 imbedded therein. The male terminals 11 are connected to corresponding electrical cables 13. A back housing 15 is secured to the front housing 3 by clamping ring 17. The back housing 15 supports a terminal support 19 in which are imbedded a plurality of female terminals 21. The female terminals 21 are connected to corresponding electrical cables 25. The male terminals 11 and female terminals 21 are arranged on their respective terminal supports such that when the front and back housings are joined together the terminals engage one another to complete the electrical connection between the cables 13 and 25.

Figure 3:
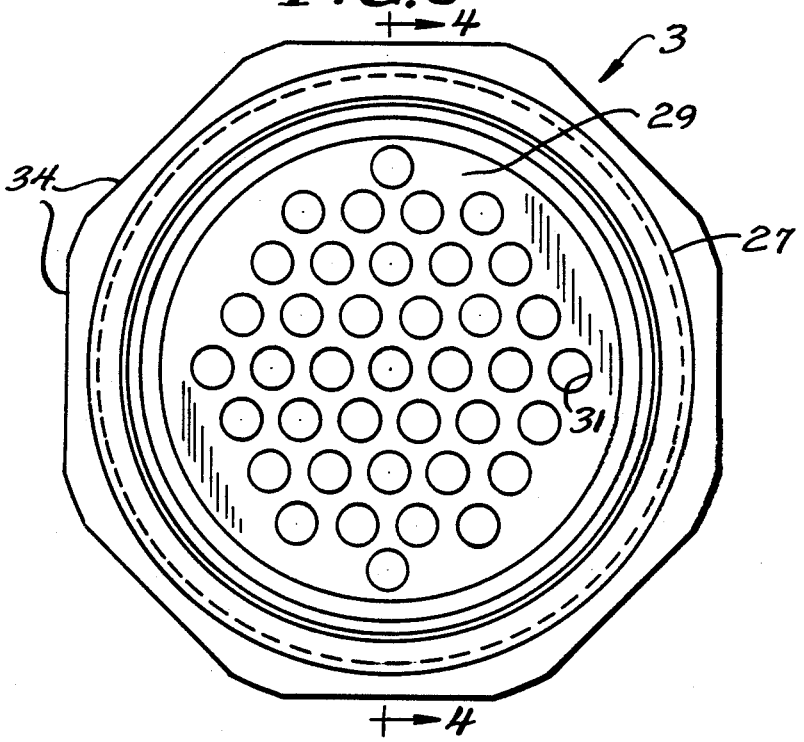
FIG. 3 shows a front view of the front housing of the invention.

The front housing 3 is shown in greater detail in FIGS. 3 and 4 and includes a substantially cylindrically shaped casing 27 made of a lightweight rigid material such as aluminum. A partition wall 29, having a plurality of through holes 31 formed therein, extends across the casing 27 and divides it into a first cavity 33 and a second cavity 35. The first cavity 33 includes a tapered wall portion 37 terminating in abutment 39 for receiving the ferule 41 formed on the end of conduit 5. Formed on the external surface of casing 27, in the area of cavity 33, are screwthreads 43 which engage mating screwthreads formed on the compression nut 7. A plurality of flat faces 34 are formed about the peripherY of casing 27 and can be engaged by a tool to assist in the assembly of the connector.

The second cavity 35 has an annular protrusion 45 formed therein for retaining the terminal support 9 in the front housing 3 as will hereinafter be described. Pressed onto the external surface of casing 27 is an annular ring 47 which engages a lip formed on the clamping ring 17 to maintain the clamping ring on the front housing 3 as shown in FIG. 2. A key 49 is also formed in the external surface of casing 27 and is engageable with a slot formed on the back housing 15 to ensure the correct positioning of the housings during the coupling operation as will hereinafter be described.

The first terminal support 9 is shown in greater detail in FIGS. 5 and 6 and consists of a basically cylindrical piece of resilient material such as silicon rubber. The support 9 has a plurality of through holes 51 formed therein, equal in number and having the same pattern as through holes 31 formed in the partition wall 29 of front housing 3. The terminal support 9 also has an annular channel 53 and integrally formed pegs 55 formed therein. When the terminal support 9 is pressed into the second cavity 35 the pegs 55 engage mating holes 57 formed in the partition wall 29 and the annular channel 53 is engaged by the annular ring 45 as illustrated in FIG. 2. The natural resiliency of the material of terminal support 9 allows the support to deform slightly so as to be able to snap into cavity 33. The engagement of pegs 55 with holes 57 ensures that the through holes 51 in the terminal support 9 are aligned with the through holes 31 in the partition wall 29.

A plurality of male terminals 11 are connected to the corresponding electric cables 13 by inserting the conductors of cables 13 into a cavity formed in the terminal and crimping the terminal so as to grip and retain the conductor. The male terminals are inserted into the through holes 51 formed in terminal support 9 until flange 65 abuts the end of raised portion 67 as shown in FIG. 2. Note, that the apertures formed in support 9 have a larger diameter portion 69 and a smaller diameter portion 71 joined by truncated conical portion 73 creating a transition area between portions 69 and 71 as best shown in FIG. 6. In this manner, the terminals 11 can be easily inserted into the large diameter portion 69 but cannot be pushed back through the smaller diameter portion 71. It should be noted that only the number of terminals that are to be used need be inserted such that some of apertures may be left empty.

The back housing 15 is shown in greater detail in FIGS. 7 and 8 and includes a substantially cylindrical casing 73. A wall 75 having a plurality of through holes 76, equal in number and having the same pattern as the through holes 31 formed in partition wall 29, extends across casing 73 and defines cavity 77. Cavity 77 has an annular protrusion 79 formed therein adjacent the wall 75. Screwthreads 80 are formed on the external surface of casing 73 and engage mating screwthreads formed on clamping ring 17. The inside diameter of cavity 77 is slightly larger than the outside diameter of casing 27 such that the front housing 3 can be inserted into the back housing 45. A slot 81 is formed in cavity 77 to receive the key 49 formed on the front housing 3 to ensure that the front and back housings are properly aligned. A flange 83 extends from casing 73 and has apertures 85 formed therein for receiving fasteners to mount the back housing to a fixture.

The female terminal support 19 is shown in FIG. 9 and consists of a substantially cylindrical piece of resilient material such as silicon rubber. The support 19 includes through holes 93 equal in number and having a pattern identical to that of the through holes formed in wall 75. An annular protrusion 95 is formed at one end of support 19 as are pegs 97. The support 19 can be pressed into cavity 77 such that pegs 97 engage mating holes 99 formed in wall 75. The annular ring 95 is trapped between wall 75 and annular protrusion 79 to retain the support 19 in the back housing 15 as best shown in FIG. 2.

The female terminals 21 are joined to the electrical cables 25 and are inserted through the apertures formed in support 19 as has been previously explained with respect to male terminals 11. A plastic cover 105 having apertures 107 corresponding to the positions of female terminals 21 is force fit into the area between the support 19 and casing 75 (see FIG. 2). The plastic cover is used to prevent a workman from inadvertently contacting the terminals 21 when, for example, the terminals are connected to an electrical power source.

In operation, the female terminals 21 are connected to the cable from an electrical power source or a machine tool, for example. The terminals 21 are inserted into through holes 93 formed in the resilient terminal support 19 of the back housing 15. The back housing may be mounted on a wall of an electrical fixture or machine tool using flange 83 if so desired.

The male terminals 11 are connected to corresponding cables from a control box, etc. and are inserted into the through holes of terminal support 9 of the front housing 3. The cables can be contained in conduit 5, in which case, the conduit 5 would be connected to front housing 3 using compression nut 7.

The casing 27 of the front housing 3 is inserted into cavity 77 of back housing 15 such that key 49 engages slot 81 and the male terminals 11 contact the female terminals 21 as shown in FIG. 2. The clamping ring 17 engages the screwthreads 49 formed on the back housing 15 such that the front and back housings are moved toward one another into a tight engagement. This tightening of the front and back housings of the connector causes the flanges 65 of the abutting male and female terminals to compress the flexible terminal supports 9 and 19, respectively. The natural resiliency of the silicon rubber material, as it attempts to restore the terminal supports to their original shape, provides pressure between the terminals to maintain contact therebetween. As a result, a pressure connection is made between the male and female terminals. Moreover, the terminal connection area is isolated from the external environment by the overlapping engagement of the front and back housings.

Although the invention has been described in its preferred form in considerable detail, it is to be understood that numerous changes in the construction, arrangement and materials of the components could be made without deParting from the spirit and scope of the invention.

What is claimed is:

1. A connector for coupling multiple electrical terminals to one another, comprising:

(a) a first housing supporting a first terminal support consisting of a resilient material including portions defining a plurality of apertures;

(b) a second housing supporting a second terminal support consisting of a resilient material including portions defining a plurality of apertures.

(c) a first and second plurality of terminals being removably located in said apertures of said first and second terminal supports, respectively, said terminals having abutment means formed thereon such that said terminals can be removed from said apertures in a first direction but are prevented from being removed from said apertures in a second direction;

(d) means for securing said first housing to said second housing such that said first plurality of terminals contacts said second plurality of terminals to apply pressure to said terminals in said second direction to thereby compress the resilient material of said first and second terminal supports whereby a pressure connection is created between said first and second plurality of terminals.

2. The connector of claim 1, further including a cover of non-conductive material supported by said first housing to prevent contact with said first plurality of terminals.

3. The connector of claim 2, wherein said cover includes portions defining a plurality of apertures corresponding to the location of said first plurality of terminals whereby connection between said first and second plurality of terminals is permitted.

4. A connector according to claim 1, wherein said means for securing said first housing to said second housing includes a clamping ring mounted on said first housing engageable with screwthreads formed on said second member whereby the force required to compress the resilient material is developed.

5. A connector according to claim 1, wherein said first plurality of terminals and said second plurality of terminals comprise mating male and female terminals, respectively.

6. A connector according to claim 1, wherein said first and second plurality of terminals are connected to electrically conductive cable.

7. A connector according to claim 1, wherein a portion of said first housing overlaps a portion of said second housing to isolate the connection between said first and second plurality of terminals from the external environment.

* * * * *